US009805570B2

(12) United States Patent
Alexander et al.

(10) Patent No.: US 9,805,570 B2
(45) Date of Patent: Oct. 31, 2017

(54) PARTICLE DETECTOR WITH DUST REJECTION

(75) Inventors: Brian Alexander, Wantirna (AU); Kemal Ajay, Mount Waverley (AU)

(73) Assignee: Garrett Thermal Systems Limited, Berkshire (GB)

( * ) Notice: Subject to any disclaimer, the term of this patent is extended or adjusted under 35 U.S.C. 154(b) by 197 days.

(21) Appl. No.: 14/127,984

(22) PCT Filed: Jun. 21, 2012

(86) PCT No.: PCT/AU2012/000711
§ 371 (c)(1),
(2), (4) Date: Mar. 14, 2014

(87) PCT Pub. No.: WO2012/174593
PCT Pub. Date: Dec. 27, 2012

(65) Prior Publication Data

US 2014/0197956 A1 Jul. 17, 2014

(30) Foreign Application Priority Data

Jun. 22, 2011 (AU) ..... 2011902443

(51) Int. Cl.
*G08B 17/10* (2006.01)
*G08B 29/24* (2006.01)

(52) U.S. Cl.
CPC ..... *G08B 17/10* (2013.01); *G08B 29/24* (2013.01)

(58) Field of Classification Search
CPC ..... G08B 17/10; G08B 17/11; G08B 29/24; G01N 21/53
(Continued)

(56) References Cited

U.S. PATENT DOCUMENTS 3,874,795 A * 4/1975 Packham ..... G01N 21/53 250/574
4,171,490 A * 10/1979 Tatetsuki ..... G08B 17/107 250/564

(Continued)

FOREIGN PATENT DOCUMENTS

EP 2224406 9/2010
WO WO-2011/106840 9/2011

OTHER PUBLICATIONS

"International Application No. PCT/AU2012/000711, International Search Report mailed Sep. 4, 2012", (Sep. 4, 2012), 7 pgs.

(Continued)

*Primary Examiner* — Naomi Small
(74) *Attorney, Agent, or Firm* — Schwegman Lundberg & Woessner, P.A.

(57) ABSTRACT

A system and method of reducing the incidence of false alarms attributable to dust in smoke detection apparatus. The method includes obtaining at least two sample air flows, subjecting a first airflow to particle reduction and measuring the level of particles in the first airflow and generating a first signal indicative of the intensity. The method also includes measuring the level of particles in the second airflow and generating a second signal indicative of the intensity. The first signal is compared to a predetermined alarm level and, if the alarm level is achieved, the first and second signals are subsequently compared and an output signal is generated based on the relative difference between the first and second signals.

18 Claims, 3 Drawing Sheets

(58) Field of Classification Search
USPC ..... 340/628
See application file for complete search history.

(56) References Cited

U.S. PATENT DOCUMENTS

| | | | | |
|---|---|---|---|---|
| 5,160,510 | A | 11/1992 | Steinbacher et al. | |
| 5,764,142 | A * | 6/1998 | Anderson | G01D 3/032 340/506 |
| 6,052,058 | A * | 4/2000 | Knox | G08B 17/107 340/607 |
| 6,285,291 | B1 | 9/2001 | Knox et al. | |
| 7,564,365 | B2 * | 7/2009 | Marman | G08B 17/103 340/628 |
| 7,669,457 | B2 | 3/2010 | Griffith et al. | |
| 8,314,710 | B2 * | 11/2012 | Knox | G08B 17/10 250/222.2 |
| 2001/0038338 | A1 * | 11/2001 | Kadwell | G08B 17/107 340/630 |
| 2004/0035184 | A1 * | 2/2004 | Yamano | G08B 17/10 73/28.01 |
| 2007/0024459 | A1 * | 2/2007 | Cole | G01F 1/6842 340/630 |
| 2008/0066527 | A1 * | 3/2008 | Ajay | G01F 1/662 73/53.01 |
| 2009/0237261 | A1 * | 9/2009 | Yokota | G08B 17/10 340/628 |

OTHER PUBLICATIONS

"International Application No. PCT/AU2012/000711, Written Opinion mailed Dec. 13, 2012", (Dec. 13, 2012), 9 pgs.
"Australian Application No. 2011902443, International-Type Search Report dated May 17, 2012", (May 17, 2012), 3 pgs.

* cited by examiner

PARTICLE DETECTOR WITH DUST REJECTION

PRIORITY CLAIM TO RELATED APPLICATIONS

This application is a national stage application under 35 U.S.C. §371 of PCT/AU2012/000711, filed Jun. 21, 2012, and published as WO 2012/174593 on Dec. 27, 2012, which claims priority to Australian Application No. 2011902443, filed Jun. 22, 2011, which applications and publication are incorporated by reference as if reproduced herein and made a part hereof in their entirety, and the benefit of priority of each of which is claimed herein.

FIELD OF THE INVENTION

The present invention relates to a particle detector employed in a sensing system for detecting particles in an air volume. More particularly, although not exclusively, the invention relates to an aspirated smoke detector. However, the invention is not limited to this particular application and other types of sensing systems for detecting particles in an air volume are included within the scope of the present invention.

BACKGROUND OF THE INVENTION

Smoke detection systems can be falsely triggered by exposure to dust. In aspirating smoke detection systems, various analytical solutions have been implemented in order to reduce the dust and thereby avoid a false alarm. In light-scatter-based smoke detection systems, dust discrimination or rejection may be implemented by using time-amplitude analysis (dust tends to produce a spike in the scatter signal which can then be removed) or by using multiple light wavelengths, multiple polarisations, multiple viewing angles, inertial separation, mechanical filtering (e.g through a porous material such as foam), or a combination of the above.

The methods mentioned above act to preferentially remove large particles before they reach the detector or they act to preferentially reduce the signal due to large particles (e.g spike detection and removal). These methods are therefore able to reduce the level of signal due to dust by more than they reduce the level of signal due to smoke. This is because dust contains more large particles relative to smoke.

While dust can be detected via spike detection in the scattered light level there is a concern that this method would not be as effective at high dust levels when the spikes due to dust merge (due to multiple particles simultaneously present in the detection region).

It is therefore an object of the present invention to provide an improved sensing system with dust detection which addresses the abovementioned disadvantages, or at least provides the public with a useful choice over known systems.

Reference to any prior art in the specification is not, and should not be taken as, an acknowledgment or any form of suggestion that this prior art forms part of the common general knowledge in Australia or any other jurisdiction or that this prior art could reasonably be expected to be ascertained, understood and regarded as relevant by a person skilled in the art.

SUMMARY OF THE INVENTION

In one aspect the invention provides, a method of particle detection including;

analysing a first air sample from an air volume being monitored and determining a level of first particles in the first air sample;

analysing a second air sample from the air volume and determining a level of second particles in the second air sample;

processing the level of first particles in the first air sample and/or level of second particles in the second air sample in accordance with at least one first alarm criterion; and in the event that at least one criterion is met:

performing differential processing of the level of first particles in the first air sample and level of second particles in the second air sample in accordance with at least one second alarm criterion; and in the event that one second alarm criterion is met;

performing an action.

The step of performing an action can include sending a signal, for example, a signal indicative of an alarm or fault condition, a change in an alarm or fault condition, a pre-alarm or pre-fault condition or other signal, a signal indicative of either or both of the level of first or second particles.

The first and second air samples can be drawn from a common air sample flow, e.g can be sub-sampled from a main flow in an air duct, be split from the same air sample flow, etc. Alternatively they can be separately drawn from the volume being monitored, .e.g using separate air sampling systems. The method can include conditioning the second air sample to create the first air sample, for example the second air sample can be filtered to form the first air sample.

The first air sample and second air sample can be analysed simultaneously, consecutively or alternately. Moreover, the analysis of the second air sample may only take place in the event that the level of first particles in the first air sample meets at least one first alarm criterion.

The second particles can include the first particles, e.g. the first particles can be a subset of the second particles. The second particles preferably include particles of interest (i.e. particles that are sought to be detected) and nuisance particles, whereas the first particles preferably substantially exclude nuisance particles, e.g. the second particles include dust and smoke particles whereas the first particles are smoke particles. Because of the statistical nature of most filtration systems used in particle detection, e.g. foam filters, electrostatic filters, cyclonic separators, total removal of one particle type is generally not possible. However, even with this level of uncertainty in the separation of particle classes effective results can be achieved. Thus it should be understood that total exclusion of all nuisance particles from the first air sample may not be possible and thus the first particles can include some nuisance particles.

In accordance with a second aspect of the invention there is provided a sensing system for detecting particles in an air volume, the sensing system including:

an inlet from the air volume for introducing an airflow into the sensing system;

a first airflow path for directing a first portion of the airflow from the inlet to a first detection chamber, the first detection chamber including detection means for detecting the level of particles within the first portion of the airflow and outputting a first signal indicative of the level of particles within the first portion of the airflow;

a second airflow path for directing a second portion of the airflow from the inlet to a second detection chamber, the second detection chamber including detection means for detecting the particles within the second portion of the airflow and outputting a second signal indicative of the level of particles within the second portion of the airflow;

particle reduction means arranged in the first airflow path upstream of the first detection chamber;

processing means adapted for receiving the first and second signals and comparing the first signal to a predetermined threshold level, wherein if the first signal is above the threshold level the processing means then compares the first and second signals and generates an output signal based on the relative difference between the first and second signals.

Advantageously, the particle reduction means acts to reduce the quantity of larger particles within the first portion of the airflow. Larger particles are generally associated with dust so the particle reduction means effectively acts as a dust reduction means. As a result, the first signal output from the first detection means can advantageously be used as an indication of the level of smoke in the first portion of the airflow.

The second portion of the airflow is not subjected to particle reduction and therefore the second signal output from the second detection means can advantageously be used as an indication of the level of smoke and dust in the second portion of the airflow.

The particle reduction means preferably includes electrostatic precipitation, a mechanical filter e.g. foam, inertial separation, or gravitational separation, or any combination of the above.

In a particularly preferred embodiment, the first signal is compared to a threshold alarm level of particle intensity. If the first signal is above the threshold alarm level this could be an indicator of smoke in the first portion of the airflow. This would generally cause an alarm to be raised. However, in this case to ensure that an alarm is not falsely raised as a result of dust in the air volume, the first signal is then compared to the second signal. If there is little or no difference (e.g. less than 30% difference) in the first and second signals then the processor signals that smoke is present and the alarm is raised. If there is a significant difference in the first and second signals (e.g. greater than 30% difference) than the processor signals that dust is present.

Advantageously, in the event that dust is present in the air volume the processor acts to modify its detection logic to reduce the probability of an alarm.

In a third aspect of the invention there is provided a sensing system for detecting particles in an air volume, the sensing system forming part of an aspirated smoke detector and including:

an inlet from the air volume for introducing an airflow into the smoke detector;

a first airflow path for directing a first portion of the airflow from the inlet to a first detection chamber, the first detection chamber including detection means for detecting the level of particles within the first portion of the airflow and outputting a first signal indicative of the level of particles within the first portion of the airflow;

a second airflow path for directing a second portion of the airflow from the inlet to a second detection chamber, the second detection chamber including detection means for detecting the level of particles within the second portion of the airflow and outputting a second signal indicative of the level of particles within the second portion of the airflow;

particle reduction means arranged in the first airflow path upstream of the first detection chamber;

processing means adapted for receiving the first and second signals and comparing the first signal to a predetermined threshold level, wherein if the first signal is above the threshold level the processing means then compares the first and second signals and generates an output signal based on the relative difference between the first and second signals;

wherein if the first and second signals differ by less than a predetermined threshold percentage the processor outputs a signal indicating that smoke is present and an alarm is triggered, and wherein if the first and second signals differ by more than a predetermined threshold percentage the processor outputs a signal that dust is present and the processor modifies its detection logic to reduce the probability of an alarm.

Preferably, the threshold percentage is 20-40% and more preferably 30%.

The invention also provides a method of reducing the incidence of false alarms attributable to dust in smoke detection apparatus, the method including obtaining at least two sample air flows, subjecting a first airflow to particle reduction and measuring the level of particles in the first airflow and generating a first signal indicative of the intensity, measuring the level of particles in the second airflow and generating a second signal indicative of the intensity, comparing the first signal to a predetermined alarm level and, if the alarm level is achieved, subsequently comparing the first and second signals and generating an output signal based on the relative difference between the first and second signals.

In particularly preferred embodiments the method further includes temporarily modifying the behaviour of the smoke detector based on the output signal.

In the aspects of the invention described above it is envisaged that the first and second detection chambers are separate from one another however it is also within the scope of the invention to provide a single detection chamber having first and second input airflow paths (as described above). Each of the first and second airflow paths further include valve means for selectively allowing one of the first and second airflow paths to pass to the detection chamber. The particle reduction means is preferably located in the first airflow path intermediate the respective valve means and the detection chamber.

BRIEF DESCRIPTION OF THE DRAWINGS

The invention will now be described, by way of example only, with reference to the accompanying drawings, in which.

DETAILED DESCRIPTION OF THE EMBODIMENTS

The preferred embodiment of the present invention allows a particle detection system to differentially detect particles with different characteristics. In the preferred form the system enables particles forming part of a first particle size distribution to be detected separately to particles belonging to a second size distribution. This is preferably implemented by detecting particles in two subsets of the total particles in the air sample where one of the subsets is substantially eliminated and performing a differential analysis of the detected particle levels.

For example, dust particles present in a room may have a particle distribution with a centre at 2 μm, and smoke caused by an electrical system fire may have a particle distribution centred at 0.75 μm. A first measurement of particles in the airflow, after conditioning such that particles in the first distribution (dust) have been removed can be made. A second measurement of the air flow including particles from both distributions can be made i.e. air with smoke and dust present can be analysed. These two particle levels can then be used to determine the signal due to smoke alone by comparing the two signals.

Figure 1:
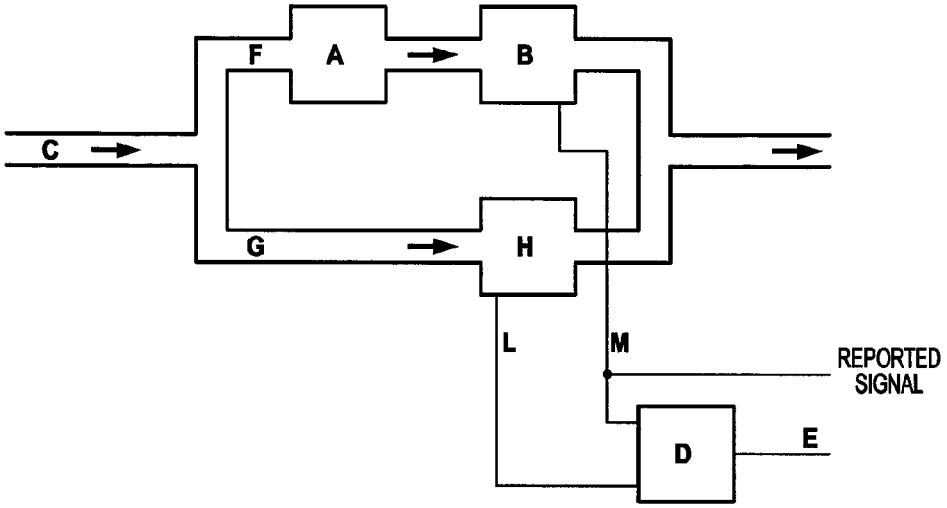
FIG. 1 is a diagrammatic illustration of a full flow detector according to an embodiment of the invention.

FIG. 1 is a diagrammatic representation of a particle detection system according to an embodiment of the invention. Air enters the detection system along duct C. The air may be clean or may contain smoke, dust or both smoke and dust simultaneously.

The air flow is then split into two airflow paths F and G. The first airflow in path F passes through means for dust reduction in region A and then passes into a detection region B. The second airflow in path G passes directly to a detection region H.

The means for dust reduction in region A could be, for example, electrostatic precipitation, mechanical filter (e.g. foam or mesh filter), inertial separation, or gravitational separation, or any combination of the above or other filtration mechanism.

The particle level in each of the detection regions B and H is then measured using conventional particle detection means and a signal M, L is generated from each of the detection regions indicative of the particle level in the respective region and output to a processor D. For example an optical particle detector, e.g. a light scattering detector or obscuration detector can be used to measure particles in each region.

Figure 2:
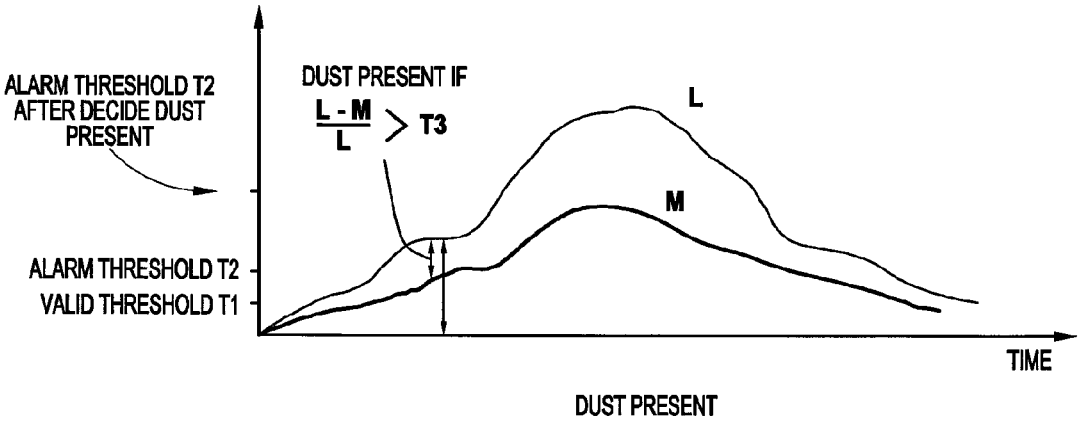
FIG. 2 is a graph illustrating an example of the signal L and M trend vs. time when dust is present.
Figure 3:
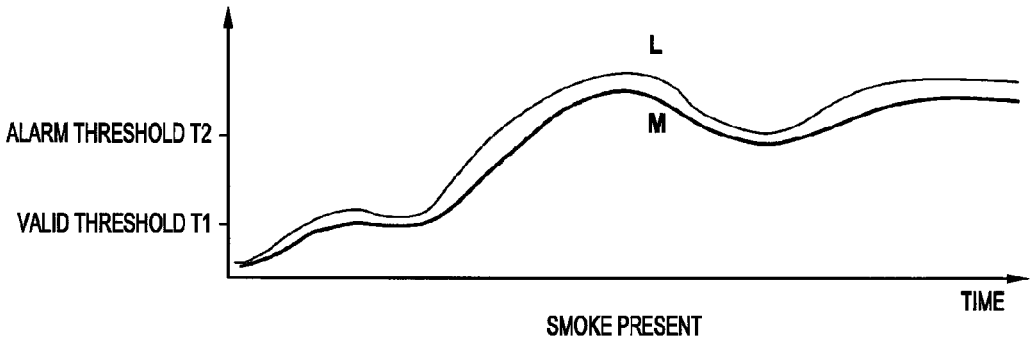
FIG. 3 is a graph illustrating the signal L and M trend vs. time when smoke is present.

The signal level M from detection region B is first compared to a "valid signal" or alarm threshold T1. A graphical representation of this process is shown in FIGS. 2 and 3. The alarm threshold is predetermined and is the level at which an alarm would typically be raised. If the signal level M from detection region B is greater than the alarm threshold T1 the signal M and L from the detectors B and H respectively are compared in processor D. If they differ by more than a predetermined amount, e.g. a threshold percentage T3 (e.g. 30%) then the processor signals "dust present" on signal line E. Otherwise it signals "smoke present".

If dust is present, then the processor modifies its alarm logic to reduce the probability of false alarm. For example, the processor could temporarily increase its alarm confirmation delays which would reduce the chance of a short dust event causing an alarm. The delays would be returned to their normal level after either i) the signals M and L differ by less than the threshold percentage T3 or ii) signal M reduces below threshold T1.

Alternatively the processor could increase its alarm level threshold T2 temporarily. The threshold would be returned to its normal level after either i) the signals M and L differ by less than threshold percentage T3 or ii) signal M reduces below threshold T1.

Some hysteresis may be used in the comparison of signal levels M and L in processor D to avoid switching too rapidly between "dust present" and "smoke present" modes.

It is also envisaged that the "dust present" signal could indicate a fault that is forwarded to a human monitoring the detection system in order to help them make a judgement about the situation and whether an alarm needs to be raised.

Figure 4:
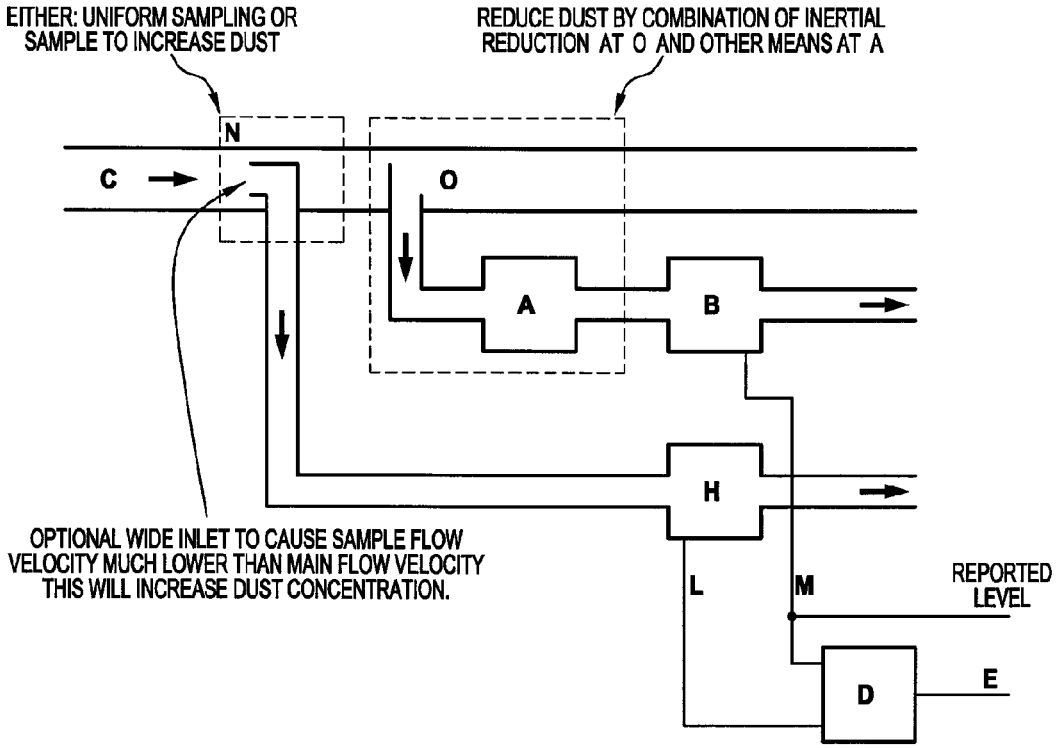
FIG. 4 is a diagrammatical illustration of sub-sampled detection system in accordance with a further embodiment of the invention.

An alternative embodiment is shown in the detection system diagrammatically illustrated in FIG. 4. In this system two sub samples are taken from the primary airflow duct C. The signal level from the two samples are compared in order to detect the presence of dust.

A first sub sample is taken in region O. This sample is intended to preferentially include smoke over dust. Dust could be reduced relative to smoke in this sample by the combination of a) inertial dust reduction at the sample point O by use of an inlet facing away from the flow and b) further dust reduction measures such as foam filtering and electrostatic precipitation after the sample point in region A.

The second sub sample is taken at N. At N the sampling of the air could be arranged to either uniformly sample dust and smoke in the air sample or optionally to increase the relative concentration of dust. The concentration of dust may be increased by, for example, slowing the sample airflow velocity relative to the main airflow velocity—by use of a larger inlet diameter than that at region O. The advantage of this would be to increase the concentration of dust reaching the subsequent detector H and thereby allow the detection of dust presence at a lower concentration in main flow C.

The air sample from region O passes to detector B and the air sample from region N to detector H. The signal from detector B is then compared to a threshold alarm level, as described above. If the signal from detector B is above the threshold alarm level then the signals from detector B and H are compared in the processor D. If the signals differ by more than a predetermined percentage (as shown in FIG. 2) then "dust present" is signalled by the processor.

Figure 5:
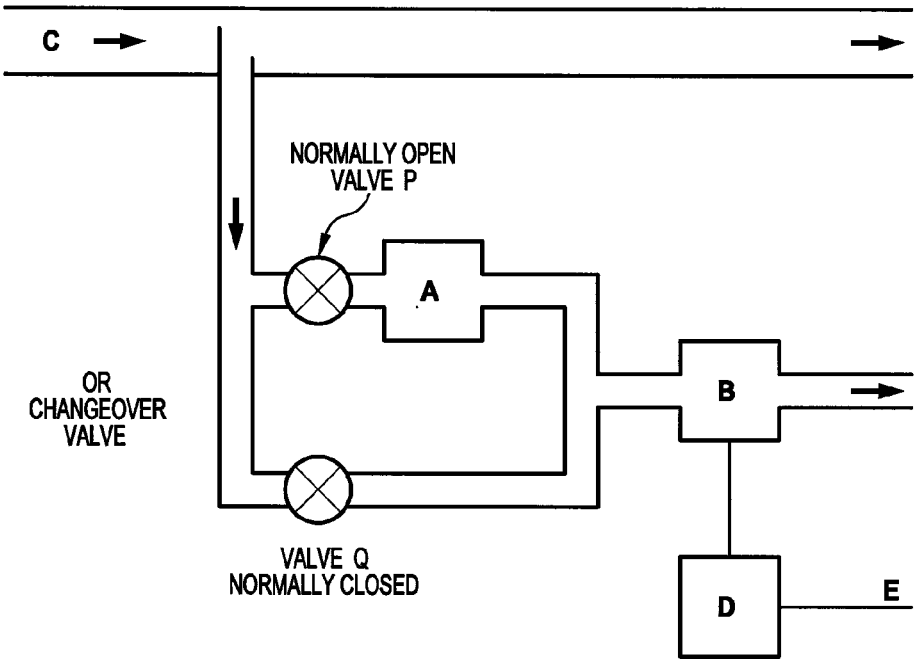
FIG. 5 is a diagrammatical illustration of another sub-sampled detection system using a single detection chamber in accordance with a further embodiment of the invention.

A further embodiment of the invention using a single detection region is shown in FIG. 5.

In this embodiment the primary airflow enters the detection system at C. The detection system of this embodiment employs a single detection region B with valves P and Q or a single changeover valve used to direct a sample of the primary airflow either:

i) through the dust reduction means A, to the detection region B or ii) directly to the detection region B.

The detection system normally runs with valve P open and valve Q closed. When a signal from detector B is detected above "valid signal" threshold or alarm threshold T1 then the valve Q is temporarily opened and simultaneously valve P is temporarily closed. If the signal level then increases by more than a threshold T3 then the processor signals "dust present".

In this embodiment it is necessary to distinguish a signal increase due to the valve switching from a natural increase in the smoke in airflow C. This could be done by switching the valves multiple times and "dust present" would only be determined if the signal increased and decreased synchronous with the switching of the valves.

Alarm detection would only be done while the valve P was open and valve Q closed.

It will be appreciated that the dust detection method described above would be effective at high concentrations of dust. The detection systems described are particularly advantageous since they allow a processor to determine whether the detected particle intensity in an airflow can be attributed to dust. This determination enables the detector system behaviour to be temporarily modified and the incidence of false smoke alarms triggered by dust can thereby be reduced.

In a preferred form the present invention uses a light scattering particle detector with a forward scattering geometry, such as the smoke detectors sold under the trade mark Vesda by Xtralis Pty Ltd. Although other types of particle detection chamber, using different detection mechanisms may also be used.

Alternative embodiments might also be extended to preferentially detect particles in any desired particle size range by selecting different particle size separation means e.g. in the present examples a filter is generally used to remove large particles from the first air sample, however in embodiments using cyclonic or other inertial separation methods, an air sample preferentially including the large particles can be analysed.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A method of particle detection including;

analysing a first air sample from an air volume being monitored and determining a level of first particles in the first air sample;

analysing a second air sample from the air volume and determining a level of second particles in the second air sample;

wherein the second air sample includes particles of interest and nuisance particles, and the first air sample substantially excludes nuisance particles;

processing at least one of the level of first particles in the first air sample; and the level of second particles in the second air sample in accordance with at least one first alarm criterion; and in the event that at least one criterion is met;

performing differential processing of the level of first particles in the first air sample and level of second particles in the second air sample in accordance with at least one second alarm criterion;

comparing a result of the differential processing with the second alarm criterion, wherein a compared result is used to make a judgment about a current situation and in the event that one second alarm criterion is met, and performing an action according to the judgment about the current situation.

2. The method according to claim 1, wherein the step of performing an action includes sending a signal indicative of: an alarm or fault condition, a change in an alarm or fault condition, a pre-alarm or pre-fault condition or other signal, a signal indicative of either or both of the level of first or second particles.

3. The method according to claim 1, wherein the second particles include particles of interest and nuisance particles, and the first particles substantially exclude nuisance particles.

4. The method according to claim 1, including filtering the second air sample to create the first air sample.

5. The method according to claim 1, wherein analysis of the second air sample only occurs in the event that the level of first particles in the first air sample meets the at least one first alarm criterion.

6. A sensing system for detecting particles in an air volume, the sensing system including:

an inlet from the air volume for introducing an airflow into the sensing system;

a first airflow path for directing a first portion of the airflow from the inlet to a first detection chamber, the first detection chamber including a particle detector for detecting a level of first particles within the first portion of the airflow and outputting a first signal indicative of the level of first particles within the first portion of the airflow;

a second airflow path for directing a second portion of the airflow from the inlet to a second detection chamber, the second detection chamber including a particle detector for detecting a level of second particles within the second portion of the airflow and outputting a second signal indicative of the level of second particles within the second portion of the airflow;

a particle filter arranged in the first airflow path upstream of the first detection chamber to substantially exclude nuisance particles from the first detection chamber; and a processor adapted for receiving the first and second signals and comparing the first signal to a predetermined threshold level, wherein if the first signal is above the threshold level the processor then compares the first and second signals and generates an output signal based on the relative difference between the first and second signals.

7. The system according to claim 6, wherein the particle filter acts to reduce the quantity of larger particles within the first portion of the airflow.

8. The system according to claim 6, wherein the first signal is compared to a threshold alarm level of particle intensity.

9. The system according to claim 6, wherein in the event that dust is present in the air volume the processor acts to modify its detection logic to reduce the probability of an alarm.

10. The system according to claim 6, wherein the first and second detection chambers are a single detection chamber having first and second input airflow paths.

11. The system according to claim 10, wherein each of the first and second airflow paths further include one or more valves for selectively allowing one of the first and second airflow paths to pass to the detection chamber.

12. The system according to claim 11, wherein the particle filter is located in the first airflow path intermediate the respective one or more valves and the detection chamber.

13. The system according to claim 6, wherein the particle filter excludes nuisance particles by one or more of the following: electrostatic precipitation, mechanical filtering, inertial separation, or gravitational separation.

14. A sensing system for detecting particles in an air volume, the sensing system forming part of an aspirating smoke detector and including:

an inlet from the air volume for introducing an airflow into the smoke detector;

a first airflow path for directing a first portion of the airflow from the inlet to a first detection chamber, the first detection chamber including a particle detector for detecting a level of first particles within the first portion of the airflow and outputting a first signal indicative of the level of first particles within the first portion of the airflow;

a second airflow path for directing a second portion of the airflow from the inlet to a second detection chamber, the second detection chamber including a particle detector for detecting a level of second particles within the second portion of the airflow and outputting a second signal indicative of the level of second particles within the second portion of the airflow;

a particle filter arranged in the first airflow path upstream of the first detection chamber to substantially exclude nuisance particles from the first detection chamber;

a processor adapted for receiving the first and second signals and comparing the first signal to a predetermined threshold level, wherein if the first signal is above the threshold level the processor then compares the first and second signals and generates an output signal based on the relative difference between the first and second signals; and wherein if the first and second signals differ by less than a predetermined threshold percentage the processor outputs a signal indicating that smoke is present and an alarm is triggered, and wherein if the first and second signals differ by more than a predetermined threshold percentage the processor outputs a signal that dust is present and the processor modifies its detection logic to reduce the probability of an alarm.

15. The system according to claim 14, wherein the threshold percentage is 20-40%.

16. The system according to claim 14, wherein the particle filter excludes nuisance particles by one or more of the following: electrostatic precipitation, mechanical filtering, inertial separation, or gravitational separation.

17. A method of reducing the incidence of false alarms attributable to dust in smoke detection apparatus, the method including obtaining at least two sample air flows, subjecting a first airflow to a particle reduction process and measuring a level of particles in the first airflow and generating a first signal indicative of the level of particles in the first airflow, wherein the first airflow substantially excludes dust particles, measuring a level of particles in the second airflow without subjecting the second airflow to said particle reduction process and generating a second signal indicative of the level of particles in the second airflow, wherein the second airflow includes smoke particles and dust particles, comparing the first signal to a predetermined alarm level and, if the alarm level is achieved, subsequently comparing the first and second signals and generating an output signal based on the relative difference between the first and second signals.

18. The method according to claim 17 further including temporarily modifying the behaviour of the smoke detector based on the output signal.

* * * * *